US006758309B2

(12) United States Patent
O'Donnell et al.

(10) Patent No.: US 6,758,309 B2
(45) Date of Patent: Jul. 6, 2004

(54) ASSEMBLY FOR SUPPORTING THE END OF A LOAD BEARING MEMBER IN AN ELEVATOR SYSTEM

(75) Inventors: Hugh James O'Donnell, Longmeadow, MA (US); Hubert E. Göser, Dannenberg (DE)

(73) Assignee: Otis Elevator Company, Farmington, CT (US)

( * ) Notice: Subject to any disclaimer, the term of this patent is extended or adjusted under 35 U.S.C. 154(b) by 217 days.

(21) Appl. No.: 10/006,006

(22) Filed: Dec. 4, 2001

(65) Prior Publication Data

US 2003/0102189 A1 Jun. 5, 2003

(51) Int. Cl.[7] ..... B66B 11/06

(52) U.S. Cl. ..... 187/259; 187/254; 187/256; 187/261; 242/613

(58) Field of Search ..... 187/256, 259, 187/261, 262, 254, 411, 251, 257, 260, 414; 242/388.6, 407.1, 600, 609, 609.1, 611, 613, 586; 24/115 R, 122.6, 115 H, 115 G

(56) References Cited

U.S. PATENT DOCUMENTS 1,436,566 A * 11/1922 Beaumont ..... 294/68.1
3,352,273 A * 11/1967 Herrweshoff et. al. ..... 24/127
4,205,871 A * 6/1980 Manabe et al. ..... 254/333
4,458,388 A * 7/1984 Farago et al. ..... 24/115 R
5,855,254 A 1/1999 Blochle

FOREIGN PATENT DOCUMENTS

| | | | | |
|---|---|---|---|---|
| DE | 365 23407 A1 | | 1/1988 | |
| FR | 1228987 A | | 9/1960 | |
| GB | 2287447 A | * | 9/1995 | ..... B66B/07/08 |
| WO | WO 01/53187 A1 | | 7/2001 | |

* cited by examiner

*Primary Examiner*—Eileen D. Lillis
*Assistant Examiner*—Thuy V. Tran
(74) *Attorney, Agent, or Firm*—Carlson, Gaskey & Olds

(57) ABSTRACT

A termination assembly for supporting and securing an end section of a belt in an elevator system includes a first support member that is fixed in a selected position within the elevator system. A second support member of one example is at least partially received over the first support member. The first support member includes at least one stop portion extending outward from a body of the first support member. The second support member includes at least one stop portion extending inward from an interior of the second support member. A plurality of motion limiters, which are inserts in one example, are received between the stop portions to limit relative rotary movement between the first and second support members. The load bearing member is received around the exterior of the second support member where it is secured in a selected position.

22 Claims, 3 Drawing Sheets

ASSEMBLY FOR SUPPORTING THE END OF A LOAD BEARING MEMBER IN AN ELEVATOR SYSTEM

BACKGROUND OF THE INVENTION

This invention generally relates to an assembly for supporting an end of a load bearing member in an elevator system.

Elevator systems typically include a cab that moves between landings in a building, for example, to transport passengers or cargo between the various floors or levels in the building. Many elevator systems include a counterweight that moves as the cab moves. A variety of driving mechanisms are known for causing the desired movement of the cab and counterweight.

Often a load bearing member couples the cab to the counterweight. The load bearing member typically is referred to as roping or a belt depending on the configuration. The load bearing member rides over sheaves as the cab moves between the various landings.

One challenge facing elevator system designers is how to adequately secure and support the ends of the load bearing member. Conventional techniques include using a socket and wedge termination assembly that clamps an end of the load bearing member between a socket and a wedge. A pivoting dead-end hitch typically is provided to accommodate necessary angular movement of the termination assembly during elevator system operation. In many situations, multiple load bearing members (i.e., multiple belts) are used and a spring support is necessary to accommodate varying loads on the different load bearing members at any given moment, for example.

Conventional arrangements are not without drawbacks and shortcomings. One drawback of the conventional socket and wedge termination assemblies is the cost associated with manufacturing such assemblies. The socket, for example, is typically made using a casting process, which tends to be expensive. Moreover, accommodating the appropriate tolerance levels required for secure arrangements introduces additional complexity and cost into the manufacturing process. Another shortcoming of conventional arrangements is that they take up valuable space within the packaging constraints of the elevator system. The amount of vertical space typically required for conventional arrangements is often considered to be too much.

There is a need for an improved belt termination assembly that is more economical and requires less space than conventional arrangements. This invention addresses that need while avoiding the shortcomings and drawbacks associated with prior designs.

SUMMARY OF THE INVENTION

In general terms, this invention is an assembly for supporting an end of a load bearing member, such as a belt, in an elevator system.

An assembly designed according to this invention includes a first support member that has at least one stop portion. The first support member is adapted to be rigidly positioned in a suitable location within the elevator system.

A second support member is received relative to the first support member. The second support member supports a portion of the load bearing member. There preferably is at least one stop portion on the second support member.

A plurality of motion limiters cooperate with the stop portions to limit relative motion between the first and second support members. In one example, the motion limiters are made using a polyurethane material.

One example embodiment of the inventive assembly includes cover members at opposite longitudinal ends of the second support member. The cover members maintain the motion limiters between the first and second support members. The cover members also preferably extend radially far enough to provide shoulder surfaces to assist in aligning a load bearing member on the second support member.

In situations where a plurality of second support members are provided to accommodate a plurality of load bearing members, spacers preferably are positioned between the covers of adjacent second support members to maintain a desired axial spacing between them and to allow the individual second support members to move relative to a corresponding first support member independent of the other second support members.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 4:
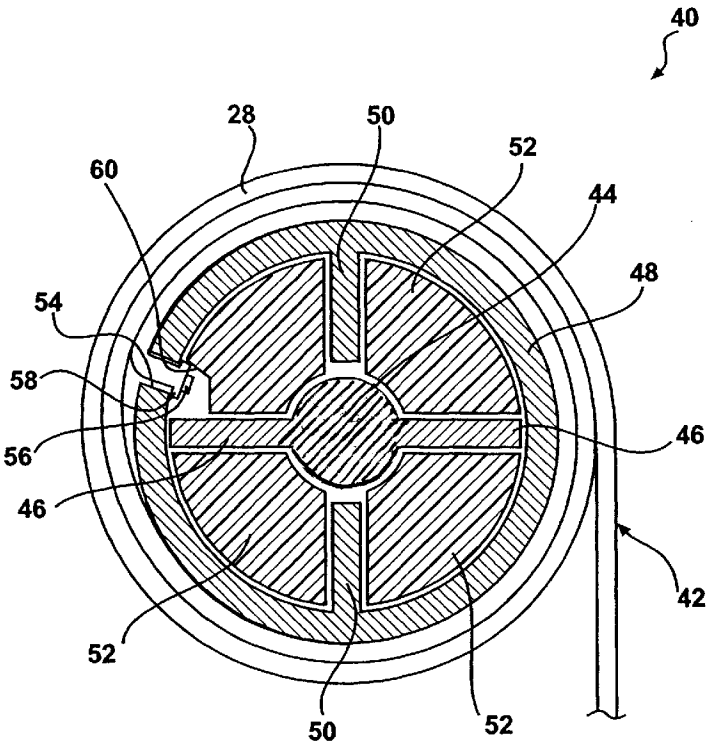
FIG. 4 is a cross sectional illustration taken along the lines 4—4 in FIG. 3.
Figure 1:
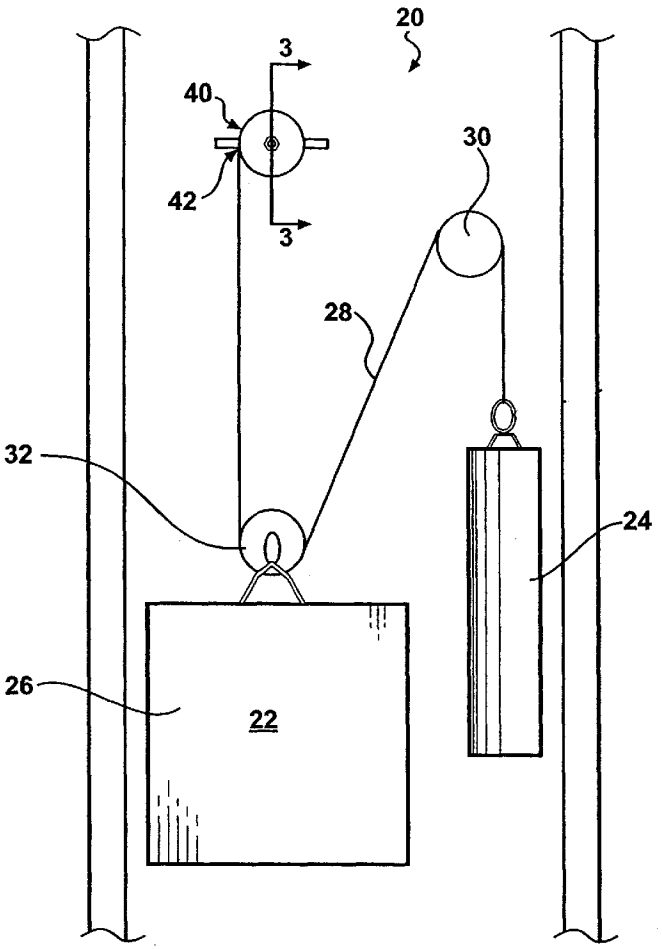
FIG. 1 schematically illustrates an example elevator system including a load bearing member termination assembly designed according to an embodiment of this invention.
Figure 2:
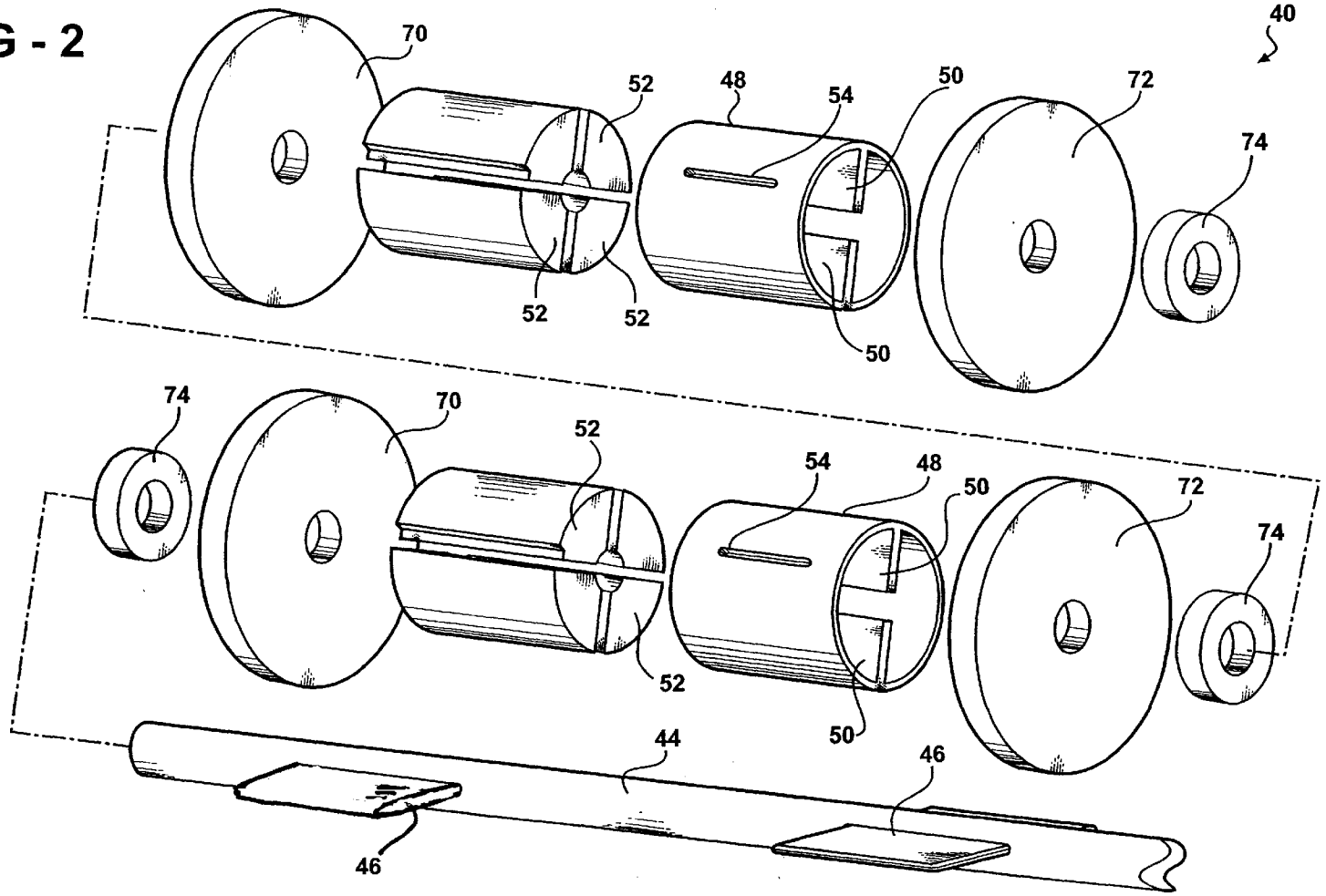
FIG. 2 is a perspective, exploded view of a load bearing member termination assembly designed according to an embodiment of this invention.

An example elevator system 20 includes a cab 22 and a counterweight 24 that move within a hoistway 26 in a conventional manner so that the cab 22 travels between landings within a building, for example. The cab 22 may be for carrying passengers and/or cargo between the various landings in the building in a conventional manner.

A load bearing member 28 couples the cab 22 to the counterweight 24. The load bearing member 28 travels along sheaves 30 and 32 that are supported within the hoistway 26 in a conventional manner. In one example, the load bearing member 28 is a coated steel belt. The load bearing member 28 of this invention may take a variety of forms and is not necessarily limited to flat belts such as coated steel belts. Other belt or roping arrangements are within the scope of this invention, however, the inventive arrangement is particularly well suited for flat belt load bearing members.

A termination assembly 40 supports and secures an end 42 of the load bearing member 28 relative to the remainder of the elevator system 20. The termination assembly 40 includes a first support member 44 that, in one example, is an elongate steel rod. At least one stop portion 46 extends radially outward from the body of the first support member 44.

The first support member 44 preferably is rigidly set in a chosen location. In one example the first support member 44 is rigidly set in the hoistway. In another example, it is supported for movement with the cab 22.

At least one second support member 48 is supported relative to the first support member such that the second member can move relative to the first support member. In the illustrated example, the second support member 48 is received at least partially over the first support member 44. In the illustrated example, a plurality of second support members 48 are generally cylindrical and aligned coaxial with the first support member 44. At least one stop portion 50 extends inward from an interior of each second support member 48. The load bearing member 28 is at least partially received (i.e., wrapped) around the exterior of the second support member 48.

Figure 3:
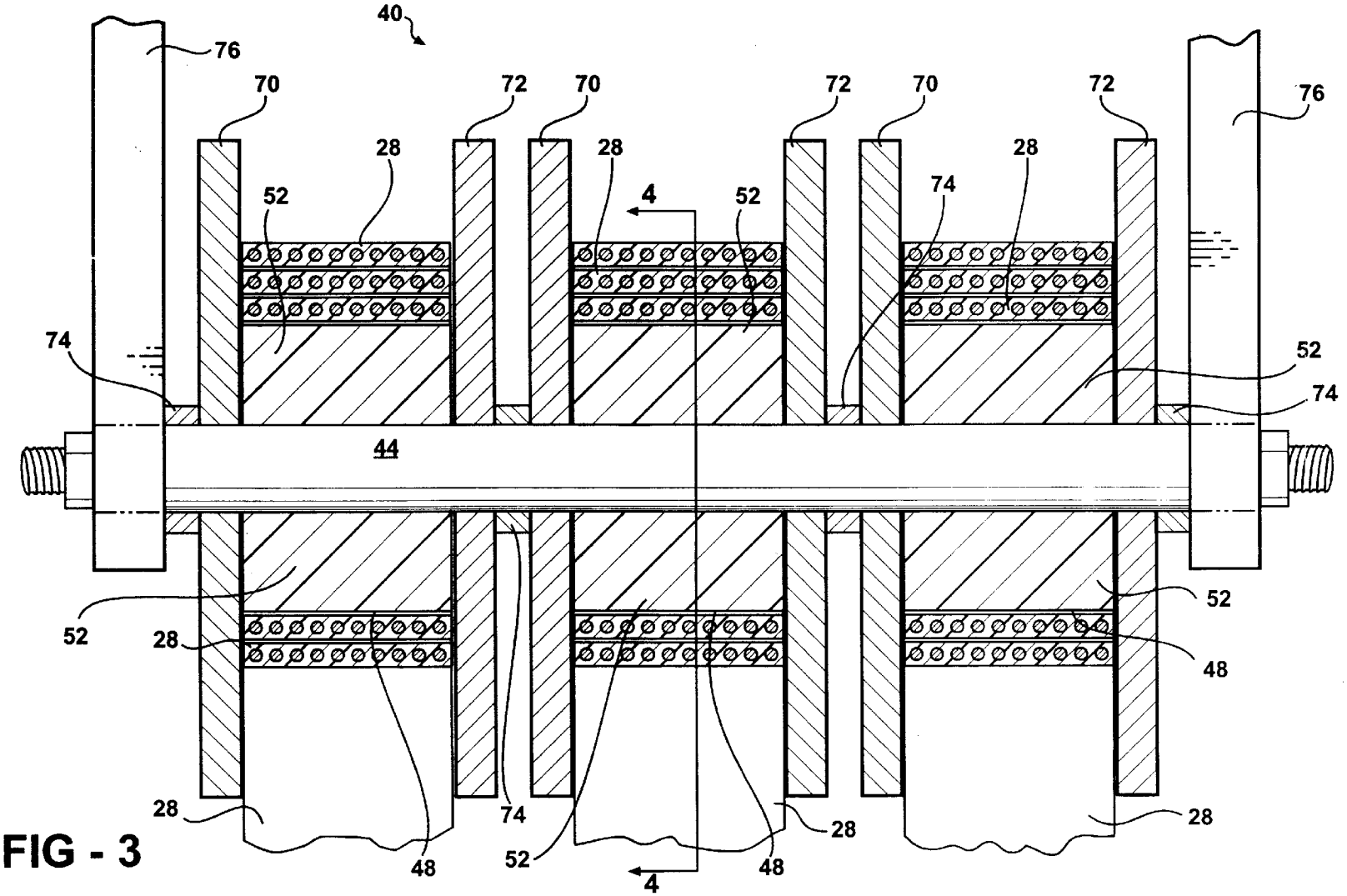
FIG. 3 is a cross sectional illustration taken along the lines 3—3 in FIG. 1.

An assembly designed according to this invention includes at least one second support member 48. Most elevator systems include more than one belt and, therefore, an assembly designed according to this invention usually will include more than one second support member 48 to accommodate the multiple belts within the elevator system. The example arrangement shown in FIG. 3 includes three second support members 48.

A plurality of motion limiters 52 cooperate with the stop portions 46 and 50 to control relative motion between the support members. The illustrated example includes motion limiters 52 that are inserts that are received between the first support member 44 and each second support member 48. Each one of the inserts preferably is positioned between a stop portion 46 on the first support member and an adjacent stop portion 50 on the second support member 48. The motion limiters 52 preferably act as compressive springs having a variable spring rate. The spring rate of the motion limiters 52 preferably increases as the inserts are compressed. The motion limiters 52 allow for some limited amount of relative motion between the second support member 48 and the first support member 44.

In one example, the motion limiters 52 are made from a polyurethane material. Other materials may be used provided that they have a suitable compression modulus to accommodate the desired amount of relative movement between the first and second support members. Given this description, those skilled in the art will be able to chose from commercially available materials to meet the needs of a particular situation.

In the illustrated arrangement, two stop portions 46 are provided in diametrically opposite directions on the first support member 44. Similarly, two diametrically opposed stop portions 50 are provided on each of the second support members 48. The preferred alignment of such an arrangement is to have the stop portions spaced approximately 90° around the central axis of the assembly. In such an arrangement, four inserts 52 are provided within the spaces between the stop portions. Each of the inserts is generally wedge-shaped in cross section. The inserts 52 of the illustrated example preferably extend axially along the entire length of the second support member 48. Similarly, the stop portions 46 and 50 preferably have an axial length at least as long as each other and, in the illustrated example, as long as the axial length of the second support member 48.

In the illustrated example, the insert motion limiters 52 support the second support member 48 in place relative to the first support member 44.

At least one stop portion on the first support member and at least one stop portion on the second support member should be provided. Various numbers of stop portions can be used and are within the scope of this invention. Of course, the number of stop portions provided dictates the number of motion limiters required.

The stop portions 46 and 50 may be integrally formed as part of the respective support members. Alternatively, the stop portions 46 and 50 may be secured to the body of the respective support member using a conventional technique, such as welding. In one example, the first support member 44 comprises a steel rod and the second support members 48 comprise steel cylinders.

The motion limiters 52 may also be formed as part of or secured to one of the support members.

Each second support member 48 receives a portion of the load bearing member 28 around the exterior of the support member 48. The load bearing member 28 preferably is wrapped around the exterior at least several times to provide an adequate frictional engagement to keep the end 42 of the load bearing member 28 secured on the termination assembly 40. In the illustrated example, the second support members 48 include a slot 54 through which a terminal end 56 of the load bearing member 28 is received. A clamp 58 that engages the load bearing member 28 near the terminal end 56 is positioned within the interior of the second support member 48. In the illustrated example, the insert 52 that is positioned closest to the slot 54 includes a cut away portion 60 to accommodate the terminal end 56 of the load bearing member 28 and the clamp 58 within the interior of the second support member 48.

Each second support member 48 preferably has a first cover 70 and a second cover 72 positioned at the longitudinal ends of the second support member 48. Spacers 74 preferably are provided between adjacent cover members and between the most outside covers and a support structure 76 within the hoistway to which the first support member 44 is secured to remain stationary. The structure 76 may be a portion of a hoistway wall or associated with a guide rail, for example.

The spacers 74 ensure that the individual second support members 48 are rotatable independent of each other. Depending on the desired amount of linear movement of the load bearing member 28 to be accommodated, the compression modulus of the inserts 52 is chosen to provide a corresponding amount of rotary movement of the second support member relative to the first support member 44. Those skilled in the art who have the benefit of this description will be able to choose appropriate tolerances and the corresponding materials required to achieve the desired amount of movement. Having each of the second support members 48 independently moveable relative to the first support member 44 allows for accommodating variations in the load on the different load bearing members 28 at different times during operation of the elevator system.

This invention provides significant advantages compared to conventional arrangements. Manufacturing cost and complexity are reduced. Additionally, angular displacement of belts is better accommodated compared to standard terminations, which require a pivoting arrangement. Moreover, the vertical space required for the termination assembly is reduced and renders the inventive arrangement more readily incorporated into most elevator system packaging constraints.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An assembly for securing an end section of a load bearing member in an elevator system, comprising:

a first support member adapted to be stationary, having at least one first stop portion;

a second support member that is moveable relative to the first support member and is adapted to receive a portion of the load bearing member and has at least one second stop portion; and a plurality of motion limiters that cooperate with the stop portions to limit relative movement between the first and second support members.

2. The assembly of claim 1, wherein the motion limiters comprise inserts received between the first and second support members and the assembly includes cover members received on opposite ends of at least one of the support members to maintain the inserts between the first and second support members.

3. The assembly of claim 1, including a plurality of first stop portions on the first support member and a plurality of second stop portions on the second support member with at least one motion limiter between each first stop portion and an adjacent second stop portion.

4. The assembly of claim 1, wherein the second support member includes an opening adapted to receive at least the end of the load bearing member.

5. The assembly of claim 1, wherein the first and second support members are coaxially arranged and the motion limiters comprise inserts that support the second support member relative to the first support member.

6. The assembly of claim 1, including a plurality of second support members and a respective plurality of motion limiters associated with each second support member, each of the second support members being independently moveable relative to the first support member.

7. The assembly of claim 6, wherein the motion limiters comprise inserts between the first and second support members and the assembly includes first and second cover members at each end of each second support member to maintain the respective inserts between the respective second support members and the first support member.

8. An assembly for securing an end section of a load bearing member in an elevator system, comprising:

a first support member adapted to be stationary, having at least one first stop portion;

a second support member adapted to receive a portion of the load bearing member and having at least one second stop portion;

a plurality of motion limiters that cooperate with the stop portions to limit relative movement between the first and second support members wherein the motion limiters comprise an elastically compressible material.

9. An elevator system, comprising:

a cab;

at least one load bearing member associated with the cab for supporting the cab, the load bearing member having an end;

a first support member fixed in a selected position and having at least one first stop portion;

a second support member about which a portion of the load bearing member is received and having at least one second stop portion; and a plurality of motion limiters that cooperate with the stop portions to limit relative movement between the first and second support members.

10. The system of claim 9, including cover members received on opposite longitudinal ends of the second support member to maintain the inserts between the first and second support members.

11. The system of claim 9, including a plurality of first stop portions on the first support member and a plurality of second stop portions on the second support member with at least one insert between each first stop portion and an adjacent second stop portion.

12. The system of claim 11, wherein the inserts comprise a compressible material.

13. The system of claim 9, wherein the first support member has a body extending along a longitudinal axis and the first stop portions extends outwardly from the body, the second support member has an interior within which the first support member is at least partially received and the second stop portion extends inwardly in the interior and wherein the motion limiters comprise inserts received between the first and second support members.

14. The system of claim 13, including a plurality of second support members and a plurality of the inserts associated with each second support member, each of the second support members being independently moveable relative to the first support member.

15. The system of claim 14, including first and second cover members at each longitudinal end of each second support member to maintain the respective inserts between the respective second support members and the first support member.

16. The system of claim 15, including spacers supported on the first support member between adjacent cover members associated with adjacent ones of the second support members.

17. The system of claim 9, wherein the second support member includes an opening through which at least the end of the load bearing member is received.

18. The system of claim 9, including a clamp member near the end of the load bearing member engaging the load bearing member within an interior of the second support member and wherein one of the motion limiters that is positioned near the end of the load bearing member includes a cutaway section that at least partially receives the clamp member.

19. The system of claim 9, wherein the first support member comprises a steel rod having ends that are fixed to a selected portion of the elevator system.

20. The system of claim 19, wherein the first stop portion comprises a steel plate rigidly fixed to the steel rod and the second support member comprises a steel cylinder and the second stop portion comprises a steel plate rigidly fixed to the interior of the steel cylinder.

21. The system of claim 9, wherein the first support member comprises a rod having ends that are fixed to a selected portion of the elevator system, the first stop portion comprises a plate rigidly fixed to the rod and the second support member comprises a cylinder and the second stop portion comprises a plate rigidly fixed to the interior of the cylinder.

22. The system of claim 9, wherein the load bearing member is wrapped at least once around the second support member.

* * * * *